United States Patent [19]

Stepanek et al.

[11] Patent Number: 5,071,155

[45] Date of Patent: Dec. 10, 1991

[54] TOE PIECE FOR A SAFETY SKI-BINDING

[75] Inventors: Premek Stepanek, Garmisch-Partenkirchen; Gerd Klubitschko, Oberau, both of Fed. Rep. of Germany; Piero G. Ruffinengo, Salt Lake City, Utah

[73] Assignee: Marker Deutschland GmbH, Eschenlohe, Fed. Rep. of Germany

[21] Appl. No.: 480,878

[22] Filed: Feb. 16, 1990

[30] Foreign Application Priority Data

Feb. 22, 1989 [DE] Fed. Rep. of Germany ..... 3905445

[51] Int. Cl.[5] ..... A63C 9/085

[52] U.S. Cl. ..... 280/625; 280/629

[58] Field of Search ..... 280/623, 625, 626, 628, 280/629, 633

[56] References Cited

U.S. PATENT DOCUMENTS

| | | | |
|---|---|---|---|
| 4,166,636 | 9/1979 | Svoboda et al. | 280/625 |
| 4,480,850 | 11/1984 | Schneider | 280/630 |
| 4,660,849 | 4/1987 | Sedlmair et al. | 280/625 |
| 4,685,696 | 8/1987 | Sedlmair et al. | 280/625 |
| 4,728,117 | 3/1988 | Stepanek | 280/625 |
| 4,735,434 | 4/1988 | Sedlmair | 280/625 |
| 4,735,435 | 4/1988 | Hornschemeyer | 280/625 |
| 4,834,414 | 5/1989 | Sedlmair | 280/625 |
| 4,883,286 | 11/1989 | Hornschemeyer | 280/629 |
| 4,930,802 | 6/1990 | Sedlmair | 280/625 |
| 4,938,497 | 7/1990 | Goud | 280/626 X |

*Primary Examiner*—Andres Kashnikow
*Assistant Examiner*—Michael Mar
*Attorney, Agent, or Firm*—D. Peter Hochberg; Mark Kusner; Louis J. Weisz

[57] ABSTRACT

A toe piece for a safety ski-binding involving a four-bar linkage comprising a base plate and an overlying cover, and having two parallel side members whose fixed front ends are pivotally mounted at the front end of the base plate, the rear free ends being pivotally connected by upper and lower link members. The free ends of the side members have boot clamps pivotally connected thereto which are held in a boot-securing position by their locking engagement with clamp-lock members pivotally mounted on the upper link member. The clamp-lock members are freed from such engagement by the action of clamp-lock release means associated with the upper link member, and pivotal thereabout, activated by forces generated by a skier's boot on the binding. Multiple embodiments of the invention are shown including release means activated by lateral forces imposed on the binding, as well as release means operated by the action of either horizontal or vertical forces thereon.

25 Claims, 6 Drawing Sheets

TOE PIECE FOR A SAFETY SKI-BINDING

TECHNICAL FIELD

This invention relates to ski-binding safety release units. More particularly, this invention relates to ski-binding toe pieces that include boot-holding clamps which release boots held thereby whenever forces exerted by the ski boot positioned in the toe piece exceed a predetermined value, either in a lateral or a vertical direction. Specifically, this invention relates to ski-bindings in which the toe pieces are provided with boot-holding clamps that under normal skiing conditions are held in a clamped position by means of independently movable clamp-locking members, which members are pivotably released from their locking position by clamp-lock release means whenever the components of the toe piece are subjected to forces in excess of a predetermined safe level for the skier.

BACKGROUND OF THE INVENTION

While ever-popular, the sport of skiing is commonly a source of serious injuries to the ankles and legs of participants as the result of falls. The possibility of such injuries is exacerbated by the fact that the length of the skis fastened to the skier's boots produce mechanical advantages that are operative during falls, which greatly magnify the forces acting on the boots, and therefore, the forces operative on the lower parts of the skier's limbs.

A skier's boot is generally attached to his ski with a ski-binding normally consisting of a toe piece and a heel piece, both of which are permanently attached to the ski. The binding is fastened to the skier's boot when the skier places the front of his boot in the toe piece, and the heel of the boot in the heel piece. A latch in the heel piece is thereupon released, forcing the heel piece against the heel of the boot and securely locking the boot in the binding.

In the past, many attempts have been made to minimize the dangers from falls, for example, through the use of "safety" bindings which hold the skier's boots to the skis only up to the point at which the bindings are subjected to forces of such magnitude that if sustained, injury to the skier's limbs would result.

A number of safety bindings have been designed that involve force-operated mechanisms which allow release of the boot from the binding toe piece, following the application of a predetermined excessive force of the boot against the toe piece. However, many such bindings are relatively sensitive to damage, and are unable to withstand the rigors associated with prolonged skiing use.

Furthermore, many safety toe piece bindings necessitate relatively involved manufacturing and assembly procedures, and consequently ential considerable cost. An additional problem commonly experienced with the more complex mechanisms arises from the friction inherent in the interaction of the considerable number of components making up the binding. Such multiple interaction, and the resulting friction, often makes the components of the bindings resist movement relative to each other, and therefore, causes the bindings to be dangerously insensitive and unreliable.

A further disadvantage of safety toe pieces of the prior art is found in the fact that their release functions can only respond to excessive forces imposed in limited directions, allowing the toe pieces to encounter dangerous forces from other directions without being released.

BRIEF DESCRIPTION OF THE INVENTION

In view of the foregoing, therefore, it is a first aspect of certain embodiments of this invention to provide a toe piece for safety ski-bindings whose mechanism is releasably responsive to predetermined excessive forces acting from multiple directions.

A second aspect of this invention is to provide a toe piece for a safety ski-binding that exhibits minimal friction between its operative parts, making the binding more reliably responsive to forces acting upon it.

Another aspect of this invention is to provide a toe piece for a safety ski-binding that is more reliable in its operation.

A further aspect of this invention is to furnish a toe piece for a safety ski-binding exhibiting a heavy-duty design that resists damage resulting from the rigors of use.

An additional aspect of this invention is to make available a toe piece for a safety ski-binding that is relatively simple and inexpensive to manufacture.

Still another aspect of this invention entails the provision of the toe piece for a safety ski-binding that includes release mechanism components that operate independently.

The foregoing and additional aspects of the invention are provided by a toe piece for a safety ski-binding comprising: a cover; a base plate; two side members; spring means; coupling means; two boot clamps; two clamp-lock members; and clamp release means, wherein said cover overlies said base plate, being spaced therefrom, said side members being parallel to and spaced from each other and having fixed ends located at the front end of said cover and said base plate, and free ends, said side members being horizontally pivotable about said fixed ends and being biased by spring means for positioning parallel to said base plate when not subjected to a lateral force acting on said boot clamps, said coupling means pivotally connecting said free ends at pivot points, and said boot clamps being pivotally connected to the same points. The clamp-lock members and said release means are both pivotally connected to said coupling means, and said clamp members, being biased by spring means, are adapted to lockingly engage and hold said boot clamps in a position capable of securing the boot of a skier in said toe piece until a boot-releasing force of predetermined magnitude acting through the boot of a skier on said toe pieces causes the disengagement of at least one of said clamp-lock members from at least one of said boot clamps, allowing said clamps to pivot and release said boot from said toe piece.

The foregoing and other aspects of the invention are provided by the toe piece described in the preceding mounted on a ski.

BRIEF DESCRIPTION OF THE DRAWINGS

The invention will be better understood when reference is had to the following drawings, in which like numbers refer to like parts, and in which.

DETAILED DESCRIPTION OF THE INVENTION

Figure 1:
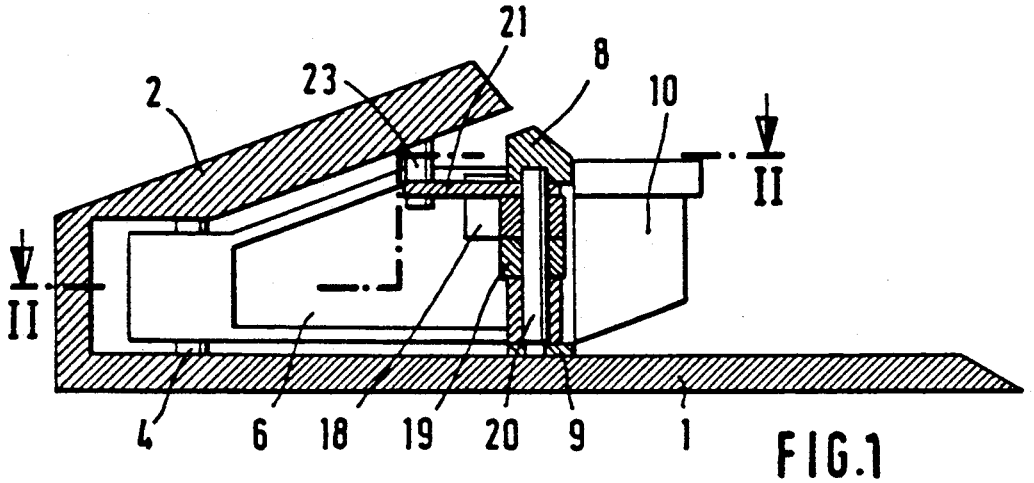
FIG. 1 is a sectional side elevation view taken through the longitudinal center of a toe piece binding of the invention in its stand-by position.

FIG. 1 is a sectional side elevation view taken through the longitudinal center of a toe piece binding of the invention in its stand-by position. As shown, a side member 6 has a fixed end pivoted about pivot pin 4 which extends between a connected cover 2 and a base plate 1. The side member 6 has a counterpart side member 7, better seen in FIG. 2, the free ends of both of which side members are horizontally pivotally connected by an upper coupling link member 8 and a lower coupling link member 9. Disposed between the coupling link members is a pivot pin 20 on which is mounted clamp-lock members 18 and 19, as well as a release lever 21. A boot clamp 10 is horizontally pivotally connected to the same pivot pin connecting the side member to the coupling link member, also better seen in FIG. 2.

Figure 2:
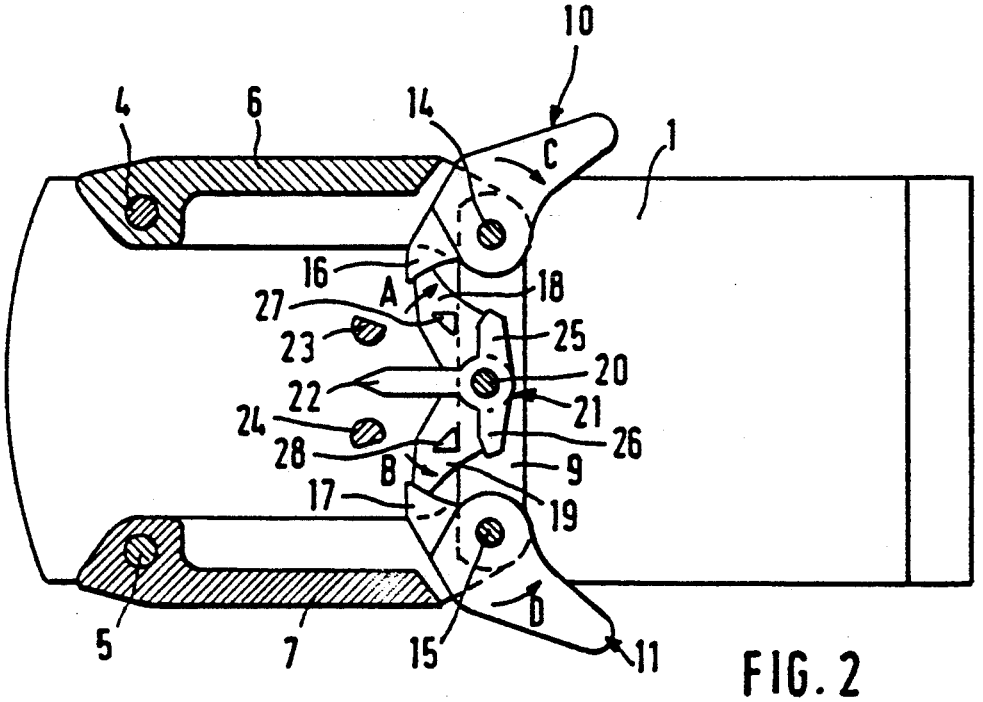
FIG. 2 is a top plan sectional view taken on line II—II of FIG. 1.

The action of the toe piece will be better understood when reference is had to FIG. 2 which is a top plan sectional view taken on line II—II of FIG. 1, which shows the base plate 1 and the side members 6 and 7 horizontally pivotally connected to pivot pins 4 and 5. In the Figure can be seen the way in which lower coupling link member 9 connects the free ends of side members 6 and 7 by means of pivot pins 14 and 15, respectively. FIG. 2 also shows the manner in which the boot clamps 10 and 11 are horizontally pivotally connected by pivot pins 14 and 15, the same pivot point attaching the lower coupling link member 9 to side arms 6 and 7.

The boot clamps 10 and 11 each include boot clamp extension arms 16 and 17, respectively, which are adapted to lockingly engage clamp-lock members 18 and 19 when the toe piece is in its ski boot locking position. Clamp lock members 18 and 19, together with release lever 21 are horizontally pivotally secured by pivot pin 20. Each of clamp-lock members 18 and 19 is provided with an actuating pin, respectively, 27 and 28, and lever stops 23 and 24 are also provided to interact with lever 21. Lever 21 includes two extending opposed arms 25 and 26, and a third arm 22 which bisects the angle formed by the opposed arm.

As can be seen, arms 6 and 7, together with the coupling link members 8 and 9 form a strong four-bar linkage that is both simple and durable. Since the linkage is connected at pivot points, it has the ability to swing from side-to-side as will be described more particularly in FIGS. 3 and 4 to accommodate lateral forces acting on the linkage through a skier's boot during skiing.

In FIG. 2, the toe piece is shown in its stand-by position, i.e., not under stress, allowing the side members 6 and 7 to dispose themselves parallel to base plate 1, a position in which the release lever 21 is inoperative and clamp-lock members 18 and 19 are engaged with the boot clamp extension arm 16 and 17, permitting boot clamps 10 and 11 to securely hold a ski boot in the binding.

It will be noted that when the toe piece is in its stand-by position, the opposed arms of the release lever are not in contact with the actuating pins 27 and 28, permitting both a compact structure, as well as optimum swivel of the four-bar linkage to be obtained. The toe piece of the invention is maintained in its stand-by position by means of a biasing spring means of the type previously known in the art which, however, is not shown in the included Figures. The spring biasing the four-bar linkage allows the linkage to swivel under the action of a lateral force, as better seen in FIGS. 3 and 4, but to return to its initial, stand-by position when such force is removed as shown in FIG. 2.

Figure 3:
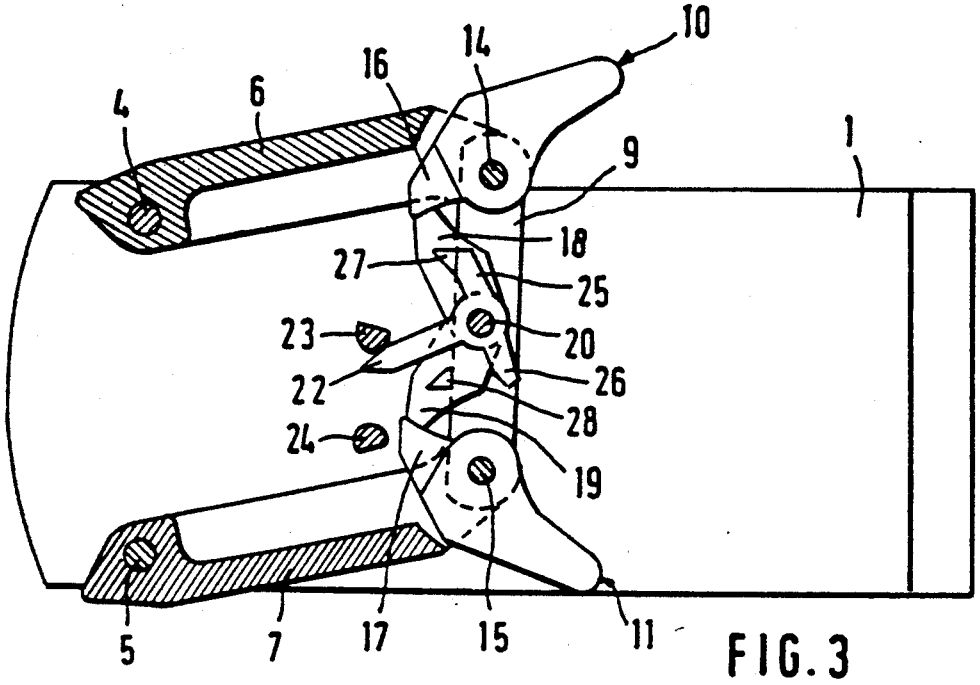
FIG. 3 is a sectional top plan view similar to that of FIG. 2 showing the toe piece of the invention subjected to a lateral force less than that required to release the binding.

FIG. 3 is a sectional top plan view similar to that of FIG. 2 showing the toe piece of the invention subjected to a lateral force less than that required to release the binding. As shown, the force of a ski boot, not shown, acting on boot clamp 10 has rotated the four-bar linkage to the right, upward in the Figure, of the binding. Such rotation is possible by virtue of side members 6 and 7 rotating about pivot pins 4 and 5, respectively, and the lower coupling link member 9 accommodating such movement while holding the side members parallel to each other as a consequence of pivot pins 14 and 15. In the position shown, clamp-lock members 18 and 19 still lockingly engage boot clamp extension arms 16 and 17, maintaining a ski boot held by boot clamps 10 and 11 securely in position. Lever arm 25 is shown contacting actuating pin 27, having been swung into that position by contact of lever arm 22 with lever stop 23; however, insufficient pressure has been developed by the contact to actuate release. Lever arm 26 and lever stop 24 are unaffected when the four-bar linkage moves to the right of the toe piece as shown, but would be engaged in similar manner if the toe piece were to be swung to the left.

Figure 4:
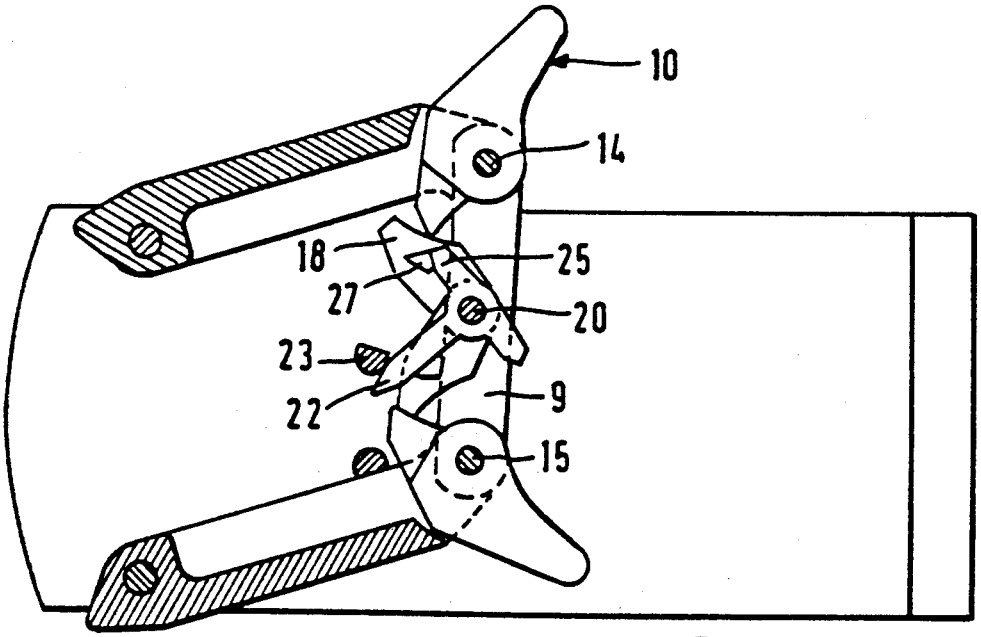
FIG. 4 is a sectional top plan view similar to that of FIG. 3, but showing the toe piece binding of the invention in its released position after being subjected to a force sufficient to release the binding.

FIG. 4 is a sectional top plan view similar to that of FIG. 3 but showing the toe piece binding of the invention in its release position after being subjected to a force sufficient to release the binding. As shown, the latter force exerted by a ski boot on boot clamp 10 has caused the side members to pivot to the right of the binding, lower coupling link member 9 moving as well due to its pivoting action about pivot pins 14 and 15. In the course of the movement of the coupling link member 9, pivot pin 20 and its coaxially mounted release lever and clamp-lock member 18 are also moved to the right. During movement of the release member, lever arm 22 encounters lever stop 23, forcing rotation of the release lever counterclockwise, bringing lever arm 25 into contact with actuating pin 27. As the lateral movement is continued, lever arm 25 exerts a sufficient pressure on actuating pin 27 protruding from clamp lock member 18, to move the clamp lock member clockwise, disengaging it from the boot clamp extension forming part of boot clamp 10. This permits the boot clamp to move counterclockwise, releasing a ski boot contained between the boot clamps.

Both the clamp lock members 18 and 19 are biased by springs forcing them in the direction shown by the arrows "A" and "B" of FIG. 2. Desirably, the boot clamps 10 and 11 are also spring biased as shown by the arrows "C" and "D" of FIG. 2. In a preferred embodiment of the invention, the return spring biasing means described consists of coil springs mounted on pivot pins 14 and 15, one end of the spring being anchored in the clamp-lock members, and the other end being anchored in the boot clamps. Such a disposition allows the spring to perform a dual function, biasing both springs A and C, and B and D.

One of the significant advantages of the embodiment is that the clamp lock members 18 and 19, or 41 and 42 of others of the Figures, are pivotally movable independently of each other; consequently, there is considerably less friction involved in operation of the release mechanism under a lateral force than would be the case if such clamp lock members were not independent, but moved in unison with each other. Such reduced friction increases the sensitivity of the release mechanism, and therefore, provides a safer toe piece binding.

Figure 5:
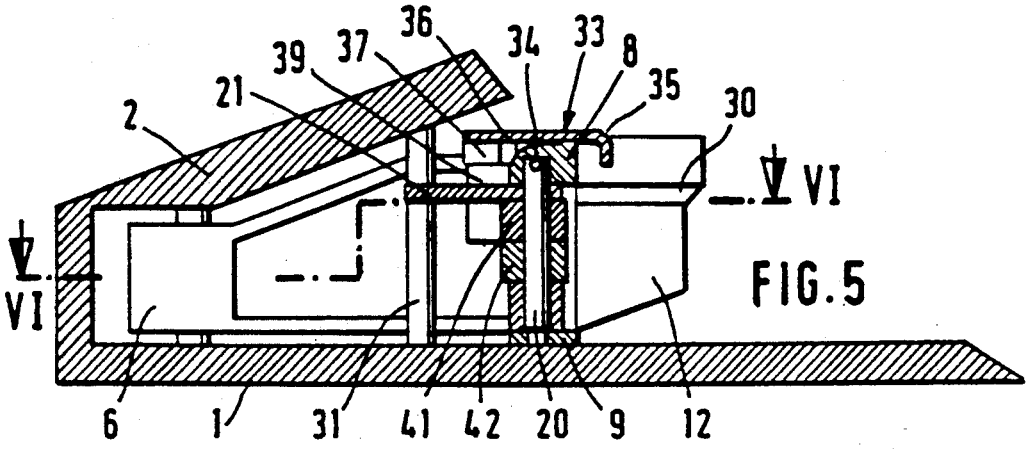
FIG. 5 is a sectional side elevation view taken through the longitudinal center of a second embodiment of the toe piece binding of the invention in its stand-by position.
Figure 6:
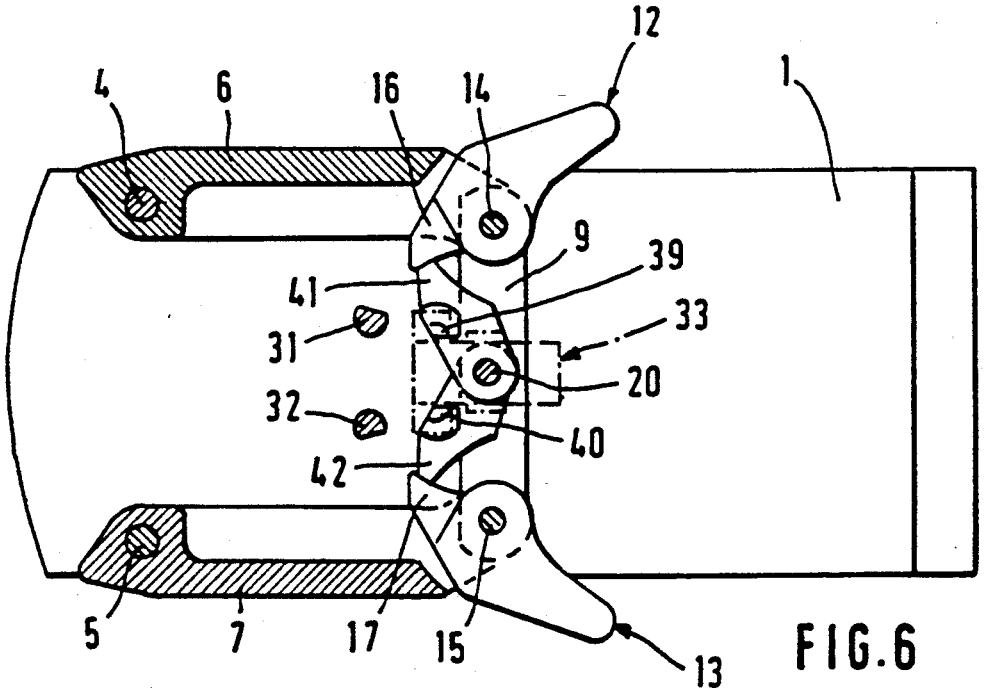
FIG. 6 is a sectional top plan view taken on line VI—VI of FIG. 5.

FIG. 5 is a sectional side elevation view taken through the longitudinal center of a second embodiment of the toe piece binding of the invention in its stand-by position. Whereas the embodiment shown in FIGS. 1–4 is primarily concerned with the release of ski boots being impacted by lateral forces, the toe piece of FIG. 5 permits both lateral forces and upwardly disposed vertical forces to trigger release of a ski boot. In the Figure is shown a base plate 1 connected to a cover 2, the free end of the cover being supported relative to the base plate by a support bolt 31, side member 6 again being horizontally pivotable. Boot clamp 12, also horizontally pivotable and attached to side member 6 as better seen in FIG. 6, is somewhat different from the boot clamps previously discussed in that it includes a boot-interfacing surface disposed at an angle from the horizontal. Such surface interfaces with the forward of the sole of a ski boot in a manner such that during an upward movement of the sole, the sole is subjected to a thrusting action which tends to move it somewhat to the right as shown in the Figure, allowing further movement of the boot sole in the upper direction to contact and to exert force on the boot-overlying end 35 of bar 33. Bar 33 is associated with upper coupling link member 8 and pivotal about bar pivot point 34, bringing the lug 37 attached to the clamp-lock-overlying end of bar 33 into contact with the protrusion extension rising from clamp lock member 41. Pivot pin 20 connecting upper and lower coupling link members 8 and 9, respectively, has mounted thereon both clamp lock members 41 and 42, as well as release lever 21.

In the case of Figure, the lever arm of the release lever cooperates with support bolt 31 during the lever's operation.

The releasing action of release lever 21 under the influence of a lateral force acting thereon is as previously described in connection with the prior Figures; however, the action of bar 33 is better seen when reference is had to FIG. 5*a*.

Figure 5A:
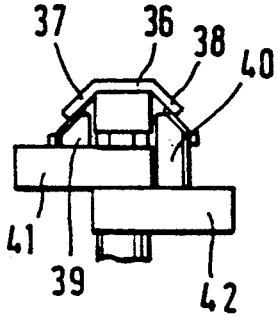
FIG. 5a is a sectional front elevation view of a portion of the release mechanism of a second embodiment of the invention that permits the toe piece binding to release when subjected to an upward force.

FIG. 5*a* is a sectional front elevation view of a portion of the release mechanism of a second embodiment of the invention that permits the toe piece of the binding to release when subjected to an upward force. Illustrated in the Figure, is the clamp-lock-overlying end of bar 33 showing lugs 37 and 38, both of which have an angled surface. Such angled surfaces contact the protrusion extensions 39 and 40, each of which has a complementary angled surface, and which are connected to clamp-lock members 41 and 42, respectively.

In operation, when an upward force is experienced on a ski boot positioned in the toe piece binding, the front of the boot contacts the boot-overlying end of bar 33, causing the bar to pivot about bar pivot 34, forcing the clamp-lock-overlying end 36 of the bar downward. This forces the angled surfaces of lugs 37 and 40 against the complementary angles of protrusion extensions 39 and 40. Since the surfaces are angled, the force includes a horizontal component which causes clamp-lock members 41 and 42 to swing away from their locking engagement with boot clamp extension arms 16 and 17, respectively, as better seen in FIG. 6. This action permits the boot clamps 12 and 13 to swing outwardly, releasing the boot as a result of the upward vertical force.

When the force is removed, the boot clamps 12 and 13 are returned by the previously referred-to biasing springs on pivot pins 14 and 15, returning the boot clamps to their locked position. It should also be pointed out that the vertical release function is operable in the embodiment described whether the side members 6 and 7 are parallel to the base plate 1, as in the case where no lateral force is acting on the binding, or whether the side members are pivoted under the influence of a lateral force to one side or the other of the base plate. It should also be noted that the spring means which biases the clamp-lock members also serves to indirectly bias the bar 33, returning it to its normal position when not subjected to an upward force.

FIG. 6 is a sectional top plan view taken on line VI—VI of FIG. 5. In the Figure, the release lever 21 is not shown to avoid complicating of the Figure, and to better illustrate the nature of the vertical release bar 33. The toe piece binding as shown in its stand-by position in which side members 6 and 7, mounted on pivot pins 4 and 5, are disposed parallel to base plate 1. Boot clamps 12 and 13 are mounted on pivot pins 14 and 15, respectively, while boot clamp extension arms 16 and 17 are lockingly engaged with clamp lock members 41 and 42. Details of the angled protrusion extensions 39 and 34 on the clamp lock members are shown in the Figure, as is the manner in which the boot-overlying end of bar 33 is cantilevered so that it is exposed to the upward movement of a ski boot thereon. The position of the support bolts 31 and 32, identical in release function to the lever stops 23 and 24 and extending from the cover 2 of the toe piece shown in FIGS. 1–4 is also to be seen.

Figure 7:
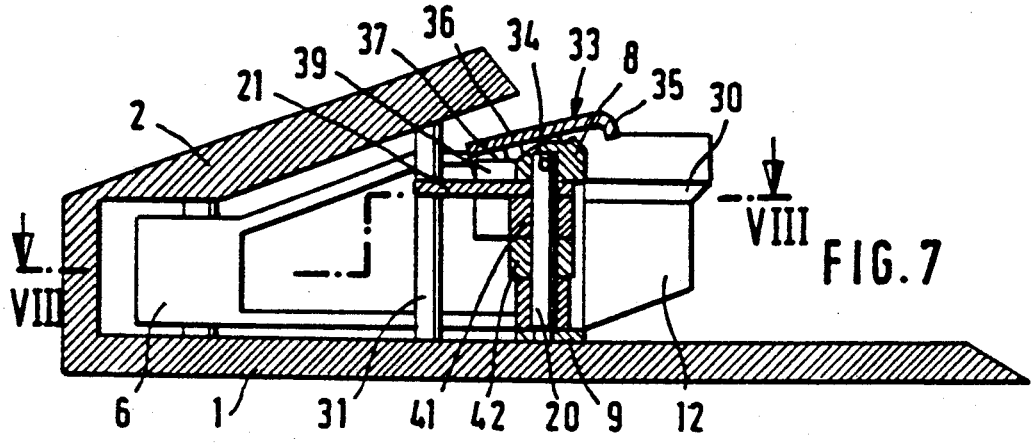
FIG. 7 is a sectional side elevation view similar to that of FIG. 5 showing the toe piece of a second embodiment of the invention in its released position after being subjected to a force sufficient to release the binding.

FIG. 7 is a sectional side elevation view similar to that of FIG. 5 showing the toe piece of a second embodiment of the invention in its released position after being subjected to a force sufficient to release the binding. As can be seen, the boot-overlying end 35 of bar 33 has been subjected to an upward force, pivoting the bar about bar pivot 34, forcing the clamp-lock-overlying end 36 with its attached lugs 37 downward against lug 39 which forms a part of clamp lock member 41. The clamp-lock members 41 and 42 are shown mounted on pivot pin 20, which extends between upper coupling link members 8 and 9. The fixed end of side member 6 is horizontally pivotally attached between connected base plate 1 and cover 2. Its free end 12 is horizontally pivotally attached to boot clamp 12 with its included angled surface 30, and to upper and lower coupling link members 8 and 9 by pivot pin 14, shown in FIG. 8. Release lever 21 is also positioned about pivot pin 20, and the support bolt 31 associated with the lever's operation, is located between base plate 1 and cover 2.

Figure 7A:
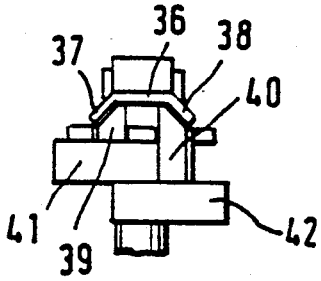
FIG. 7a is a sectional front elevation view of a portion of the release mechanism of the second embodiment of the invention that permits the toe piece binding to release when subjected to an upward force of predetermined magnitude.

FIG. 7*a* is a sectional front view of a portion of the release mechanism of the second embodiment of the invention that permits the toe piece binding to release when subjected to an upward force of predetermined magnitude. The clamp-lock-overlying end 36 with its angled lugs 37 and 38 are shown in contact with the complementary angled surfaces of protrusion extensions 39 and 40 attached to clamp lock members 41 and 42, respectively.

Figure 8:
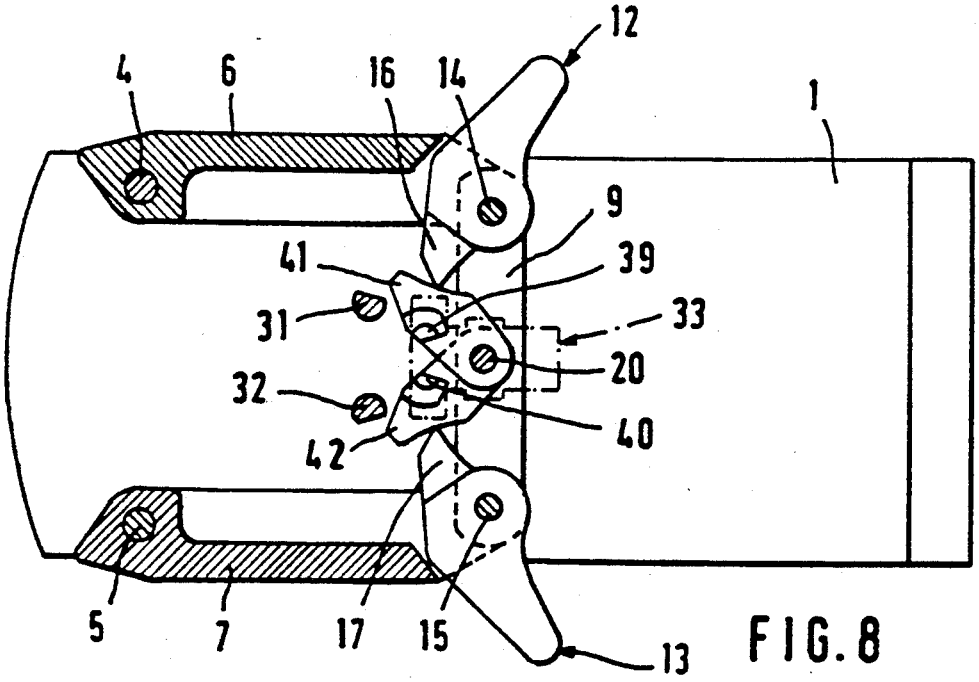
FIG. 8 is a sectional top plan view taken on line VIII—VIII of FIG. 7.

FIG. 8 is a sectional top plan view taken on line VIII—VIII of FIG. 7. As indicated, the boot clamps 12 and 13 are disposed in their boot-unlocking position. Such unlocking results from the disengagement of boot clamp extension arms 16 and 17 from the clamp lock members 41 and 42, caused by the downward action of the lugs attached to the clamp-lock-overlying end of bar 33 on the protrusion extensions 39 and 40 rising from the clamp lock members. The Figure again illustrates the relationship between base plate 1 and side members 6 and 7 horizontally pivotally attached by pivot pins 4 and 5 to the base plate. Support bolts 31 and 32 are also shown, although release lever 21 has been omitted for the sake of clarity.

Figure 9:
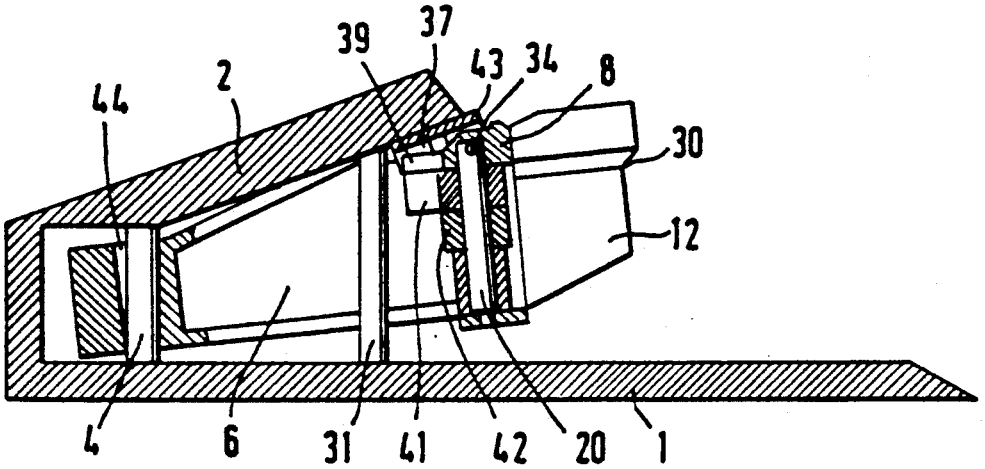
FIG. 9 is a sectional side view taken through the longitudinal center of a third embodiment of the toe piece binding of the invention after being subjected to an upward force sufficient to release the binding.

FIG. 9 is a sectional side view taken through the longitudinal center of a third embodiment of the toe piece binding of the invention being subjected to an upward force sufficient to release the binding. Illustrated in the Figure is a toe piece comprising a base plate 1 attached to a cover 2, and including a side member 6 whose fixed end is both vertically and horizontally pivotally connected to a pivot pin 4. Support bolt 31 connects base plate 1 and cover 2, but plays no part in the release function. Side member 6 has attached thereto a boot clamp 12 with a boot interfacing surface disposed at an angle from the horizontal 30, horizontally pivoted by a pivot point better seen in FIG. 10. The free end of the side member 6 is connected to its opposing side member, seen in FIG. 10, by means of upper and lower coupling link members, and the two are connected by a pivot pin 20 on which are mounted clamp lock members 41 and 42. Associated with upper link member 8, and vertically pivotal about the longitudinal axis of said link member is a bar 43 with a connected lug 37 having an angled surface complementary to a similarly angled protrusion extension 39 connected to clamp lock member 41. The binding is released upon being subjected to either a lateral or a vertical force, since the complementary angled surfaces are affected both by horizontal and vertical force components generated by the action of a ski boot against the side of boot clamp 12, or its angled surface 30. Both lateral and horizontal movements of the side 6 are accommodated by tapered pivot pin hole 44.

When subjected to excessive force, the mechanism releases due to such force being exerted either laterally, or vertically upward, against angled surface 30, both types of forces causing an upward movement of side member 6 and boot clamp 12, bringing the bar 37 into contact with the lower surface of cover 2. Such contact causes the bar 43 to pivot, bringing the complementary angled surfaces on lug 37 and protrusion extension 39 into contact, resulting in a lateral force on clamp-lock members 41 and 42 and causing their release.

Figure 10:
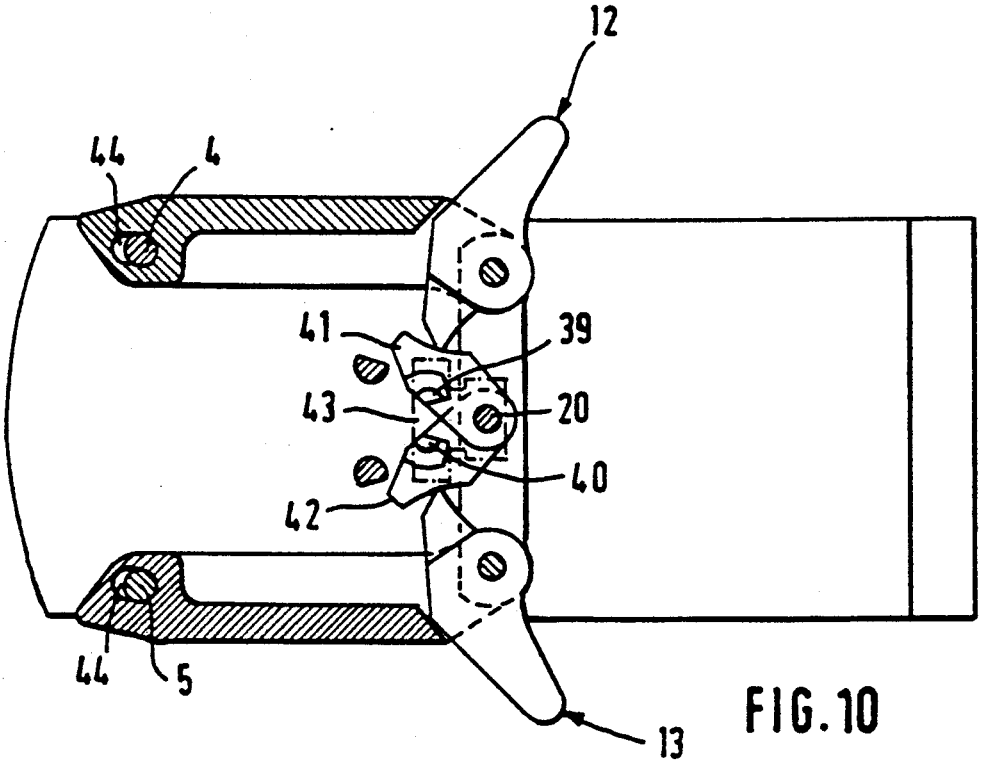
FIG. 10 is a sectional top plan view of the toe piece binding of FIG. 9.

FIG. 10 is a sectional top plan view of the toe piece binding of FIG. 9 showing the tapered, upwardly flared pivot pin holes 44 in which are located pivot pins 4 and 5, maintaining the side members horizontally, and upwardly vertically pivotal with respect to the base plate. Like FIG. 9, FIG. 10 shows the toe piece binding in its released position in which boot clamps 12 and 13 are swung outwardly as a result of the fact of disengagement of the boot clamp extension arms from clamp-lock members 41 and 42, caused by the pivoting action of bar 43 located adjacent pivot pin 20.

As in the case of all of the bindings in the invention, the pivoting of the side members takes place against the resistance of spring means, tending to retain the four-bar linkage in its stand-by position.

Figure 11:
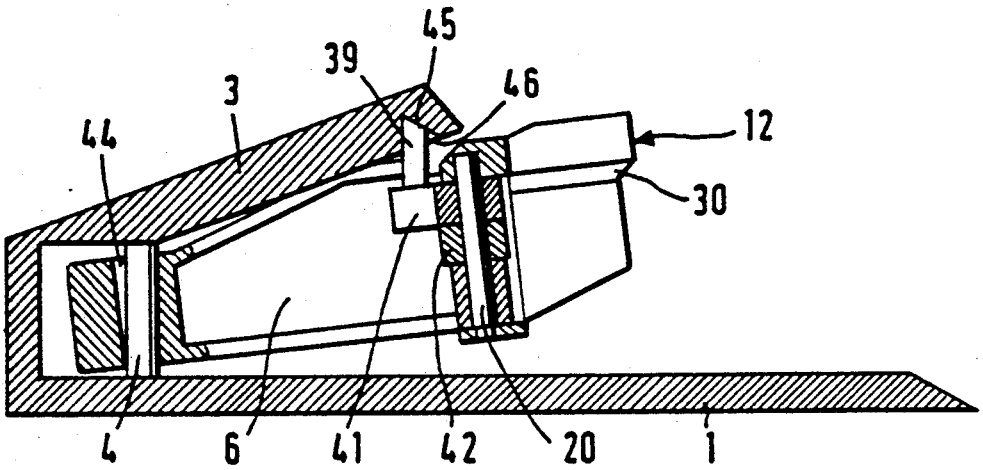
FIG. 11 is a sectional side view taken through the longitudinal center of a fourth embodiment of the toe piece binding of the invention after being subjected to an upward force sufficient to release the binding.

FIG. 11 is a sectional side view taken through the longitudinal center of a fourth embodiment of the toe piece binding of the invention being subjected to an upward force sufficient to release the binding. Shown in the Figure, are base plate 1 connected to a cover 3, a pivot pin 44 being disposed between the two. The fixed end of side member 6 is horizontally and upwardly vertically positioned about pivot pin 4, while the free end of the side member 6 is attached to a boot clamp 12 which includes an angled surface 30. The pivot pin 20 is disposed between upper and lower coupling link members and has clamp lock members 41 and 42 horizontally pivotally attached thereto, each of which includes an angled protrusion extension rising upwardly therefrom. Cover 3 is provided with a cover slot 46 having an angled slot surface complementary to the angled surface of the protrusion extension.

When the device is subjected to a vertical force resulting from the contact of the ski boot with the angled surface 30, engagement of the complementary angled surfaces causes a rotation of the clamp-lock members, freeing them from the boot clamp extension arms and releasing the ski boot from the toe piece. In instances where the boot clamp 12 is subjected to a lateral force, the protrusion extension 39 slides along the cover slot 46 until the extension encounters a transverse end thereof, whereupon a lateral force is again exerted on clamp-lock member 41, disengaging the clamp-lock member from the boot clamp extension arm of boot clamp 12 and releasing the ski boot.

Figure 12:
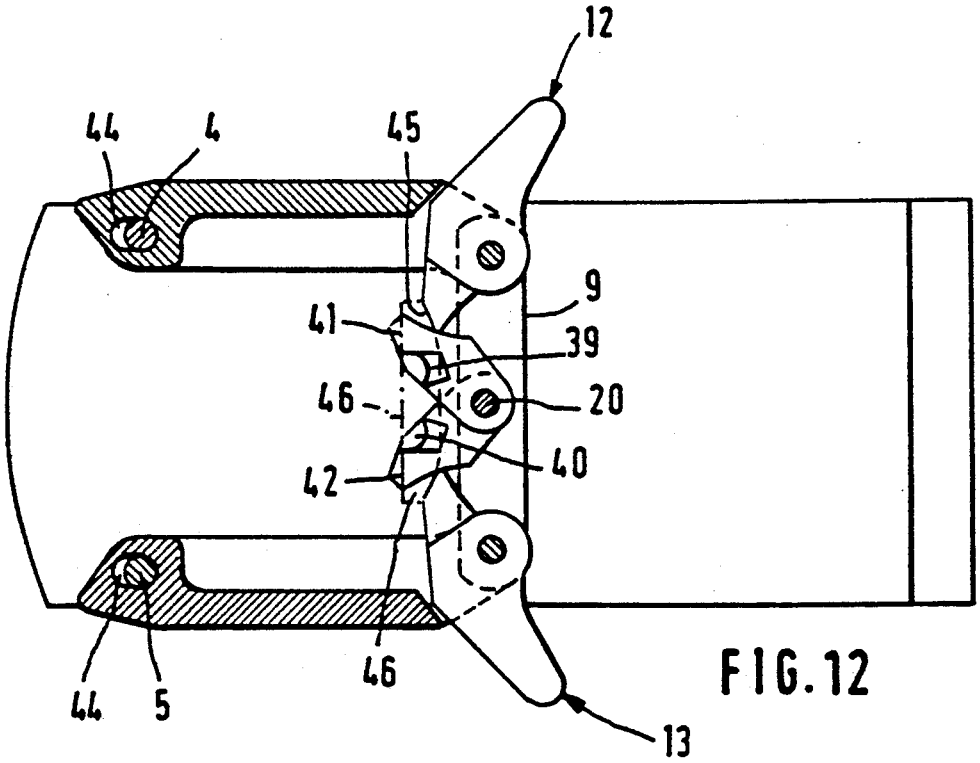
FIG. 12 is a sectional top plan view of the toe piece binding of FIG. 11.

FIG. 12 is a sectional top plan view of the toe piece binding of FIG. 11 in which the method of attachment of the side members to the base plate by means of pivot pins 4 and 5 in the tapered pivot pin holes 44 can be seen. The Figure illustrates the situation in which in an upward vertical force has caused the pivoting of clamp lock members 41 and 42 as a result of the contact of the angled surfaces of protrusion extensions 39 and 40 with the complementary angled surface of the cover slot 46. This has caused pivoting of the clamp-lock members about pivot pin 20, allowing the pivoting of boot clamps 12 and 13 which are attached by lower coupling link member 9.

While in accordance with the patent statutes, a preferred embodiment and best mode has been presented, the scope of the invention is not limited thereto, but rather is measured by the scope of the attached claims.

What is claimed is:

1. A toe piece for a safety ski-binding comprising:

a cover;

a base plate;

two side members;

spring means;

coupling means;

two boot clamps;

two clamp-lock members; and clamp-lock release means, wherein said cover overlies said base plate, and being spaced therefrom, said side members being parallel to and spaced from each other and having fixed ends, and free ends, said side members being attached to the front end of said cover and said base plate for pivotal movement about their fixed ends and said side members being biased by spring means to a position extending parallel to side edges of said base plate when not being subjected to a lateral force acting on said boot clamps, said coupling means extending between said side members and being pivotally connected to pivot points on said free ends, and each said boot clamp being pivotally connected to a respective one of said pivot points on said free ends, and wherein, said clamp-lock members and said clamp lock release means are pivotally connected to said coupling means, said clamp-lock members biased by spring means towards a locking position for engaging and holding said boot in a position capable of securing the boot of a skier in said toe piece, said clamp lock release means being adapted to engage at least one of said clamp-lock members when a boot-releasing force of predetermined magnitude acts through the boot of a skier on said toe piece to cause the disengagement of said at least one of said clamp-lock members from at least one of said boot clamps, thereby allowing said clamps to pivot and release said boot from said toe piece.

2. A toe piece according to claim 1 wherein said boot clamps include a boot-interfacing surface disposed at an angle from the horizontal.

3. A toe piece according to claim 2 in which said boot clamps are biased by spring means to retain said clamps in a boot-securing position, engaged with said clamp-lock members, until said clamp-retaining bias is overcome by the application of said boot-releasing force.

4. A toe piece according to claim 3 wherein the same spring means used to bias said boot clamps is used to bias the clamp-lock members with which they are engaged.

5. A toe piece according to claim 1 in combination with a ski.

6. A toe piece according to claim 1 wherein each of said clamp-lock members is provided with release actuating means extending upwardly therefrom, and said release means comprises:

a release lever, and two stop means, wherein said lever has two extending opposed arms and an extending third arm bisecting the angle formed by said opposed arms, said third arm being positioned between said stop means, whereby when said side members are horizontally pivoted by said releasing force acting laterally on said boot clamps, said coupling means, together with said release lever is moved thereby until the third arm of said lever engages one of said stop means, such engagement causing said lever to pivot to a position in which one of said opposed arms engages one of said actuating means, moving the clamp-lock member from which said actuating means extends to a position in with it becomes disengaged from the boot clamp with which it was previously engaged.

7. A toe piece according to claim 6 wherein said stop means are pin-like numbers attached to said toe piece so as to be stationary relative to said top and said base.

8. A toe piece according to claim 6 wherein said boot clamps include a boot-interfacing surface disposed at an angle from the horizontal.

9. A toe piece according to claim 8 in which said boot clamps are biased by spring means to retain said clamps in a boot-securing position, engaged with said clamp-lock members, until said clamp retaining bias is overcome by the application of said boot-releasing force.

10. A toe piece according to claim 9 wherein the same spring means used to bias one of said boot clamps is used to bias the clamp-lock members with which they are engaged.

11. A toe piece according to claim 6 in combination with a ski.

12. A toe piece according to claim 6 wherein said coupling means includes a coupling link member connecting the upper portion of the free ends of said side members, said link member being provided with a bar at right angles thereto, said bar comprising part of said release means, said bar being vertically pivotal about the longitudinal axis of said link member and having one end configured to overlie the front end of a ski boot inserted in said toe piece, and the other end of said bar being configured to overlie said clamp-lock members and being provided with lugs having a first angled surface extending downwardly therefrom, and wherein said clamp-lock members include protrusions extending upward therefrom having a second angled surface, said first and second angled surfaces being complementary, and being juxtaposed and adapted to contact each other, whereby when the force of said contact is associated with said releasing force acting through said boot upwardly on said overlying end, a lateral force is imposed on said second angled surface by said first angled surface, pivoting said clamp lock members and disengaging them from said boot clamps, thereby allowing said clamps to pivot to release said boot from said toe piece.

13. A toe piece according to claim 12 wherein the end of the bar overlying said ski boot is angled downward.

14. A toe piece according to claim 12 wherein said boot clamps include a boot-interfacing surface disposed at an angle from the horizontal.

15. A toe piece according to claim 14 in which said boot clamps are biased by spring means to retain said clamps in a boot-securing position, engaged with said clamp-lock members, until said clamp retaining bias is overcome by the imposition of said boot-releasing force.

16. A toe piece according to claim 15 wherein the same spring means used to bias one of said boot clamps is used to bias the clamp-lock member with which it is engaged.

17. A toe piece according to claim 12 in combination with a ski.

18. A toe piece according to claim 1 wherein said coupling means includes a coupling link member connecting the upper portions of the free ends of said side members, and said release means comprises:

a bar, and said boot clamps, wherein said bar is positioned at right angles to said link member and said bar is vertically pivotal about the longitudinal axis of said link member and configured to overlie said clamp lock members, said bar being provided with lugs having a first angled surface extending downward therefrom, and said clamp lock members including protrusions extending upward therefrom having a second angled surface, said first and second angled surfaces being complementary, and being juxtaposed and adapted to contact each other, and said side members being both horizontally and vertically pivotal about their fixed ends, said boot clamps including a boot-interfacing surface disposed at an angle from the horizontal, whereby both in the case where said contact is associated with said releasing force acting upwardly by the action of said boot on said interfacing surface, as well as in the case where said releasing force acts laterally on said boot clamps, a lateral force is imposed on said second angled surface by said first angled surface, pivoting said clamp-lock members and disengaging them from said boot clamps, thereby allowing said clamps to pivot horizontally to release said boot from said toe piece.

19. A toe piece according to claim 18 in which said boot clamps are biased by spring means to retain said clamps in a boot-securing position, engaged with said clamp lock members, until said clamp retaining bias is overcome by the application of said boot-releasing force.

20. A toe piece according to claim 19 wherein the same spring means used to bias one of said boot clamps is used to bias the clamp-lock member with which it is engaged.

21. A toe piece according to claim 18 in combination with a ski.

22. A toe piece according to claim 1 wherein said release means comprises:

said cover;

said clamp-lock members, and said boot clamps, said cover having a transverse slot traversing part of its lower surface at the rear end thereof, said slot having a transverse first angled surface, and said clamp lock members having protrusions extending upward therefrom having a second angled surface, said first and second angled surfaces being complementary, and being juxtaposed and adapted to contact to each other, said side members being both horizontally and vertically pivotal about their fixed end, and said boot clamps including a boot-interfacing surface disposed at an angle from the horizontal, whereby both in the case where said contact is associated with said releasing force acting upwardly by the action of said boot on said interfacing surface, as well as in the case where said releasing force acts laterally on said boot clamps so as to move said protrusions against a transverse end of said slot, a lateral force is imposed on said protrusions, pivoting said clamp members and disengaging them from said boot clamps, thereby allowing said clamps to pivot to release said boot from said toe piece.

23. A toe piece according to claim 22 in which said boot clamps are biased by spring means to retain said clamps in a boot-securing position, engaged with said clamp members, until said clamp retaining bias is overcome by the application of said boot-releasing force.

24. A toe piece according to claim 23 wherein the same spring means used to bias one of said boot clamps is used to bias the clamp-lock member with which it is engaged.

25. A toe piece according to claim 24 in combination with a ski.

* * * * *